US009145599B2

(12) United States Patent
Kariyazaki

(10) Patent No.: US 9,145,599 B2
(45) **Date of Patent: *Sep. 29, 2015**

(54) HIGH-STRENGTH THICK STEEL PLATE FOR STORAGE CONTAINER EXCELLENT IN LOW-TEMPERATURE TOUGHNESS OF MULTI-LAYER WELDED JOINT

(75) Inventor: Makoto Kariyazaki, Kakogawa (JP)

(73) Assignee: Kobe Steel, Ltd., Kobe-shi (JP)

( * ) Notice: Subject to any disclaimer, the term of this patent is extended or adjusted under 35 U.S.C. 154(b) by 932 days.

This patent is subject to a terminal disclaimer.

(21) Appl. No.: 12/814,950

(22) Filed: Jun. 14, 2010

(65) Prior Publication Data

US 2011/0020167 A1 Jan. 27, 2011

(30) Foreign Application Priority Data

Jul. 27, 2009 (JP) ..... 2009-174302

(51) Int. Cl.

| | |
|---|---|
| ***C22C 38/02*** | (2006.01) |
| ***C22C 38/00*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |

(52) U.S. Cl.

CPC ..... *C22C 38/02* (2013.01); *C22C 38/001* (2013.01); *C22C 38/002* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01)

(58) Field of Classification Search

CPC ..... C22C 38/001; C22C 38/002
USPC ..... 420/84, 89–93, 109; 148/332–336
See application file for complete search history.

(56) References Cited

FOREIGN PATENT DOCUMENTS

| | | |
|---|---|---|
| JP | 63-103020 | 5/1988 |
| JP | 63-169325 | 7/1988 |
| JP | 2000-345281 | 12/2000 |
| JP | 2008111165 A * | 5/2008 |

OTHER PUBLICATIONS

Nishimura et al., English machine translation of JP 2008-111165, May 15, 2008, whole document.*
Office Action, issued May 1, 2012, in Korean Patent Application No. 2010-0071907.

* cited by examiner

*Primary Examiner* — Jie Yang
*Assistant Examiner* — Caitlin Kiechle
(74) *Attorney, Agent, or Firm* — Oblon, McClelland, Maier & Neustadt, L.L.P.

(57) ABSTRACT

The high-strength thick steel plate for storage container contains: C: 0.12-0.16% (means mass %, hereinafter the same), Si: 0.05-0.5%, Mn: 1-1.5%, Al: 0.01-0.05%, Nb: 0.003-0.02%, Mo: 0.03-0.3%, V: 0.025-0.04%, Cr: 0.05-0.3%, Cu: 0.05-0.5%, Ni: 0.15-0.55%, Ca: 0.0005-0.006% respectively, and the RP value as defined by an equation (1) below satisfies the relation of $RP \geq 4.5\times10^{-8}$.

$$RP=\{[Nb]/93+1/60\times[V]/51\}\times[Mo]/96 \quad (1)$$

where [Nb], [V] and [Mo] respectively represent the content (mass %) of Nb, V and Mo.

8 Claims, 1 Drawing Sheet

HIGH-STRENGTH THICK STEEL PLATE FOR STORAGE CONTAINER EXCELLENT IN LOW-TEMPERATURE TOUGHNESS OF MULTI-LAYER WELDED JOINT

BACKGROUND OF THE INVENTION

1. Field of the Invention

The present invention relates to a high-strength steel plate used in constructing a storage container, more specifically to a steel plate excellent in low-temperature toughness of a heat affected zone (may be hereinafter referred to as "HAZ") of a joint section when a multi-layer welded joint is formed.

2. Description of the Related Art

Because a thick steel plate used after being subjected to quenching and tempering (may be hereinafter referred to as "QT steel plate) has high strength and high toughness as well as excellent weldability, it has been conventionally used as a steel plate for a pressure vessel, mainly a tank. In recent years, such QT steel plate is widening its application area to a thick steel plate used for a storage container of a nuclear reactor and the like for example.

With respect to the thick steel plate applied to a storage container, there is a tendency that higher strength (585 MPa or above of the tensile strength, for example) is required in the light of the enlarged design of a welded structure in recent years. Further, because its construction is often planned in a cold area, the base metal and the welded joint section are required to have excellent low-temperature toughness.

For high strengthening of a thick steel plate applied to such application as described above, carbon of a specific amount or above (0.12 wt % or above, for example) is required. Also, when a welded joint is to be formed by welding thick steel plates, multi-layers are welded (multi-layer welded joint), however it is said that carbon content is preferable to be as less as possible in order to secure the toughness of such welded joint.

The structure of the multi-layer welded joint section shows a complicated aspect due to the construction of the joint. In other words, in the multi-layer welded joint section, it is known that tempered coarse grain HAZ (CG-HAZ) structure, tempered fine grain HAZ (FG-HAZ) structure, and two phase region heating HAZ (IR-CGHAZ) structure are present according to its position, and that the tempered CG-HAZ structure is the most embrittled section among these structures. That is, improvement of the toughness of the tempered CG-HAZ structure is considered to be the most effective means in order to make the low-temperature HAZ toughness of the welded joint excellent.

With respect to the cause of the tempered CG-HAZ structure becoming of low toughness (most embrittled section), presence of the grain boundary cementite in the tempered CG-HAZ structure can be cited. In other words, a crack is generated due to a fracture of the cementite present in the grain boundary of the structure, which means that the more the grain boundary cementite is, the more crack generation points are, and such fact is considered to be the cause of becoming of low toughness.

As a technology for obtaining a thick steel plate excellent in low-temperature toughness of the welded joint, a variety of proposals have been presented so far. As such technology, in Japanese Unexamined Patent Application Publication No. S63-103020 and Japanese Unexamined Patent Application Publication No. S63-169325 for example, a thick steel plate in which the toughness of the multi-layer welded joint is improved by controlling Nb content in the steel plate is proposed. The principle of the technology is that the island-shaped martensite (MA) in the tempered CG-HAZ is made easily decomposed in a succeeding weld pass.

However, even in such technology, the grain boundary cementite still remains even after MA has been decomposed, and from the viewpoint of improving low-temperature toughness by reducing the grain boundary cementite in the tempered CG-HAZ structure, the actual situation is that enough improving effect has not been exerted.

SUMMARY OF THE INVENTION

The present invention was developed considering such circumstances, and its purpose is to provide a high-strength thick steel plate for a storage container with 585 MPa or above tensile strength excellent in low-temperature toughness of an HAZ of a joint section by reducing generation of the grain boundary cementite in the tempered CG-HAZ structure of the multi-layer welded joint.

The thick steel plate in relation with the present invention that could solve the problems described above contains: C: 0.12-0.16% (meansmass %, hereinafter the same), Si: 0.05-0.5%, Mn: 1-1.5%, Al: 0.01-0.05%, Nb: 0.003-0.02%, Mo: 0.03-0.3%, V: 0.025-0.04%, Cr: 0.05-0.3%, Cu: 0.05-0.5%, Ni: 0.15-0.55%, Ca: 0.0005-0.006% respectively, the balance including iron with inevitable impurities, and the RP value as defined by an equation (1) below satisfies the relation of $RP \geq 4.5\times10^{-8}$.

$$RP=\{[Nb]/93+1/60\times[V]/51\}\times[Mo]/96 \quad (1)$$

where [Nb], [V] and [Mo] respectively represent the content (mass %) of Nb, V and Mo.

With regard to the thick steel plate of the present invention, it is also useful to further contain Ti: 0.025% or below according to the necessity, and the property of the thick steel plate is further improved by containing Ti.

According to the present invention, by controlling the content of Nb, V and Mo so as to satisfy the relation of the equation (1) and setting the chemical componential composition of the steel plate within a proper range, generation of the grain boundary cementite in the tempered CG-HAZ structure of the multi-layer welded joint can be reduced, and a high-strength thick steel plate for a storage container with 585 MPa or above tensile strength excellent in low-temperature toughness of a HAZ of the joint section can be obtained. Such thick steel plate is extremely useful as a material of a storage container for a nuclear reactor.

DETAILED DESCRIPTION OF THE PREFERRED EMBODIMENTS

Figure 1:
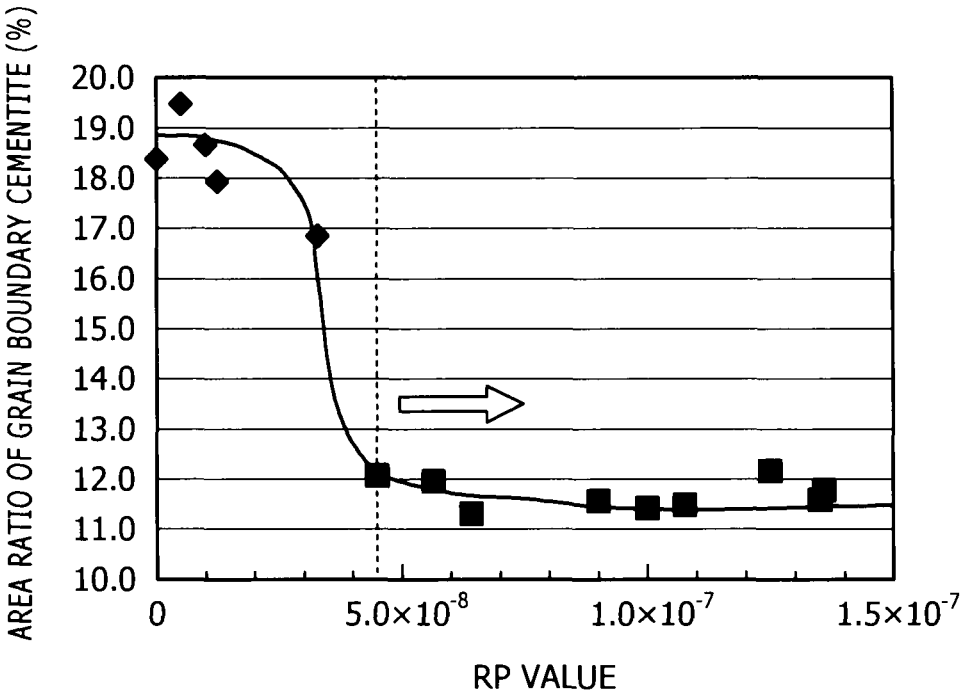
FIG. 1 is a graph showing the relation between the RP value and the area ratio of the grain boundary cementite.

In order to reduce generation of the grain boundary cementite in the tempered CG-HAZ structure which is the most embrittled section of the multi-layer welded joint, the present inventors have made intensive studies over a wide range and in detail especially on the influence of the chemical composition exerted to grain boundary precipitation of cementite. As a result, it was found out that a thick steel plate (QT steel plate) capable of securing excellent low-temperature toughness of an HAZ of a welded joint can be obtained by finding out a componential system capable of suppressing generation quantity of the grain boundary cementite of the tempered CG-HAZ even with C content capable of securing high strength of 585 MPa or above and stability of the toughness of a basic metal (0.12% or above), and the present invention was completed. Actions and effects of the present invention will be described according to the progress leading to completion of the present invention.

In welding steel plates (weld heating temperature: 1,350° C. or above), all the precipitates are solid-dissolved, and the precipitates are formed sequentially in a succeeding cooling step. Here, in order to suppress the quantity of the grain boundary cementite, two methods below are possible.

(a) To reduce the cementite quantity itself (b) To suppress grain boundary precipitation in precipitating the cementite First, with respect to above (a), because it is preferable that an element other than Fe captures C when cementite is precipitated, addition of an element whose carbonate precipitation starting temperature is higher than the precipitation starting temperature of the cementite ($Fe_3C$) is considered to be effective.

Therefore, the precipitation starting temperature of each element was investigated, and it was revealed that the precipitation starting temperature was high in order of NbC (1,060° C.)>VC (980° C.)>$Fe_3C$ (690° C.)>$Mo_2C$ (590° C.). Further, the precipitation starting temperature can be calculated by inputting the chemical componential composition of steel to a comprehensive thermodynamic calculation software (Thermo-Calc, procurable from ITOCHU Techno-Solutions Corporation).

From the above result, Nb and V were considered to be effective in capturing C. However, according to the study of the present inventors, there is a difference in ability of forming carbide between Nb and V. It was found out that with respect to Nb, all of the content contributes to formation of carbide, however, with respect to V, only a part of the content contributes to formation of carbide. Then, with respect to the content of V, the quantity of carbide was calculated by the Thermo-Calc, correction was made to match the non-equilibrium state, and it was revealed that only 1/60 of the content contributed to formation of carbide.

From the result of the study described above, the rate $N_b$ and V capture carbon results to be proportionate to the amount of a substance contributing to formation of the carbide of Nb and V ([Nb]/93+1/60×*[V]*/51: where [Nb] and respectively are the content (mass %) of Nb and V: atomic mass of Nb=93, atomic mass of V=51, carbide formation rate of V=1/60). In other words, as ([Nb]/93+1/60×*[V]*/51) becomes higher, the quantity of the cementite becomes less.

On the other hand, with respect to above (b), it was considered to have a solid solution element in the grain boundary in order to suppress grain boundary precipitation of the cementite. Here, "grain boundary" is a portion where there is disturbance in atomic arrangement, therefore a large element that cannot effect substituting solid-dissolving inside a crystal is considered to be effective as the element captured by the grain boundary. Also, when an element sufficiently larger than an Fe element forming a basic crystal and presenting in a solid solution state in precipitating the cementite was searched for, it was revealed to be Mo. That is, the grain boundary precipitation suppressing effect of the cementite is proportionate to the amount of a substance of Mo (Mo/96: atomic mass of Mo=96). In other words, as (Mo/96) becomes higher, the grain boundary precipitation suppressing effect becomes stronger.

Because the effects of above (a), (b) occurs successively [(a)→(b)] and progress while affecting with each other, each of the relational expression described above can be obtained also by multiplication. That is, as a formation suppressing parameter of the grain boundary cementite, the RP value obtainable by the equation (1) below is obtained.

$$RP=\{[Nb]/93+1/60\times[V]/51\}\times[Mo]/96 \quad (1)$$

where [Nb], [V] and [Mo] respectively represent the content (mass %) of Nb, V and Mo.

The larger the RP value decided by the content of Nb, V and Mo is, the less the quantity of the cementite precipitated in the grain boundary is, and in order to suppress the grain boundary cementite quantity to a predetermined value or below and exert excellent low-temperature toughness, the RP value should satisfy $4.5\times10^{-8}$ or above (RP value$\geq4.5\times10^{-8}$) (refer to Table 2 and FIGS. 1, 2 below). Also, when any element (Nb, V and Mo) is contained excessively, weldability is deteriorated, and therefore it is preferable to adjust the content of each element as described below.

[Nb: 0.003-0.02%, V: 0.025-0.04%]

Nb and V are elements with low solid-solubility to cementite and strong in affinity with C. However, when either of them is contained excessively, gigantic precipitates are formed and the toughness of the joint is deteriorated, and therefore the content should be properly adjusted as above. Also, the preferable range of Nb content is 0.004-0.010%, and the preferable lower limit of V content is 0.030%.

[Mo: 0.03-0.3%]

Mo is weak in affinity with C compared with Fe and is present in a solid solution state in the crystal boundary when the cementite is precipitated. However, if Mo content becomes excessive, coarse precipitates are formed in the boundary after the cementite is precipitated and the toughness of the base metal deteriorates, and therefore the content should be properly adjusted as above. Also, the preferable range of Mo content is 0.10-0.20%.

Next, the componential composition of the steel (base metal) according to the present invention will be described. As described above, the steel plate according to the present invention cannot attain excellent low-temperature toughness if the content of each chemical component (element) is not within a proper range, even if the chemical componential composition satisfies that the RP value stipulated by the equation (1) is within a predetermined range. Accordingly, in the thick steel plate according to the present invention, in addition to that the RP value stipulated by a proper amount of Nb, V and Mo [equation (1) above] is controlled to a predetermined range, the amount of each chemical component is also required to be within a proper range as described below. The reasons of limiting the range of these components are as described below.

[C: 0.12-0.16%]

Although C is an important element in improving quenchability of a steel plate and securing the strength, the toughness of the joint is deteriorated if the content becomes excessive, and therefore it should be 0.16% or below. From the viewpoint of securing weldability, C content is preferable to be as little as possible, however if it is below 0.12%, quenchability deteriorates on the contrary and the strength cannot be secured. The preferable upper limit of C content is 0.14%.

[Si: 0.05-0.5%]

Si acts as a deoxidizing agent in smelting steel and exerts an effect of increasing the strength of steel. In order to effectively exert such effects, Si content should be 0.05% or above. However, when Si content becomes excessive, the toughness of the joint deteriorates, and therefore it should be 0.5% or below. Also, the preferable lower limit of Si content is 0.20% and the preferable upper limit is 0.30%.

[Mn: 1-1.5%]

Mn is an element exerting an effect increasing the strength of a steel plate. In order to effectively exert such effect, Mn should be contained by 1% or above, preferably 1.2% or above. However, when Mn is contained excessively exceeding 1.5%, the toughness of the joint deteriorates. The preferable content is 1.4% or below.

[Al: 0.01-0.05%]

Although Al is added as a deoxidizing agent, sufficient effect is not exerted when the content is below 0.01%, and cleanliness of the steel plate is damaged when it is contained excessively exceeding 0.05%. The preferable lower limit of Al content is 0.015%.

[Cr: 0.05-0.3%]

Cr is an element acting effectively in improving quenchability of a steel plate and increasing the strength. Further, it acts effectively also in improving corrosion resistance of the steel plate. However, when Cr content becomes excessive, the toughness of the joint deteriorates, and therefore it should be 0.3% or below. In order to effectively exert the effects of Cr, it should be contained by 0.05% or above, preferably 0.10% or above.

[Cu: 0.05-0.5%]

Although Cu is an element effective in increasing the strength, when its content becomes excessive, cracking easily occurs in hot rolling and the toughness of the joint deteriorates. Therefore it should be 0.5% or below. In order to effectively exert the effects of Cu, it should be contained by 0.05% or above, preferably 0.15% or above.

[Ni: 0.15-0.55%]

Ni is an element effective in improving the strength and toughness of a steel plate. However, when Ni content becomes excessive, the toughness of the joint deteriorates, and therefore it should be 0.55% or below. Also, in order to effectively exert the effects of Ni, it should be contained 0.15% or above, preferably 0.40% or above.

[Ca: 0.0005-0.006%]

Ca is an element effective in improving the characteristic of the material in Z direction (plate thickness direction) by controlling the form of sulfide in steel. However, when Ca content becomes excessive, inclusions in steel increase and the toughness of the steel plate and the toughness of the joint deteriorate, and therefore it should be 0.006% or below: Also, in order to effectively exert the effects of Ca, it should be contained 0.0005% or above, preferably 0.001% or above.

The contained elements stipulated in the present invention are as described above, and the balance is iron and inevitable impurities. As the inevitable impurities, inclusion of the elements brought in by the situation of raw material, manufacturing materials, manufacturing equipment and the like (for example, P, S, N, Sn, As, Pb and the like) is allowable. With respect to P, S, and N out of these impurities, it is preferable to be suppressed as described below. Further, it is also effective to positively contain Ti further by a predetermined amount, and thereby the characteristic of the steel plate is further improved.

[P: 0.02% or below]

Because P which is an impurity element causes tempering embrittlement, its amount is preferable to be as little as possible. From the viewpoint of securing the toughness, it is preferable to suppress P content to 0.02% or below, more preferably 0.01% or below. However, it is difficult industrially to make P in steel 0%.

[S: 0.01% or below]

S is an impurity causing tempering embrittlement, and its amount is preferable to be as little as possible. From the viewpoint of securing the toughness, it is preferable to suppress S content to 0.01% or below, more preferably 0.002% or below. However, it is difficult industrially to make S in steel 0%.

[N: 0.01% or below]

N is an impurity causing hardening, and its amount is preferable to be as little as possible. From the viewpoint of securing the toughness, it is preferable to suppress N content to 0.01% or below, more preferably 0.006% or below. However, it is difficult industrially to make N in steel 0%.

[Ti: 0.025% or below]

Ti is an element effective in forming precipitates with N in an HAZ of the welded joint and in suppressing coarsening of the structure by pinning. Although such effects increase as its content increases, the toughness of the joint deteriorates if it is contained excessively, and therefore it should be limited to 0.025% or below. Also, the preferable lower limit to effectively exert the effects of Ti is 0.008%.

The thick steel plate according to the present invention can be manufactured according to ordinary conditions (rolling temperature, draft, quenching temperature, tempering temperature) using the molten steel satisfying the above componential composition. The present invention relates to a thick steel plate, and the thick steel plate generally means in the field, as defined in JIS, one with 3.0 mm or above plate thickness. However, the plate thickness of the thick steel plate of the object of the present invention is preferably 25 mm or above. That is, according to the present invention, even when a welded joint is formed by multi-layer welding of steel plates with a large plate thickness, excellent toughness of an HAZ is achieved. The thick steel plate according to the present invention can be used, for example, as the material of a structure requiring low-temperature toughness of a joint, and deterioration of low-temperature toughness of a weld heat affected zone can be prevented not only in low-medium heat input welding but also in high heat input welding.

EXAMPLES

Although the present invention will be explained below further specifically referring to examples, the present invention intrinsically is not to be limited by the examples below, and can be implemented with modifications added appropriately within the scope adaptable to the purposes described previously and later, and any of them is to be included within the technical range of the present invention.

The steel with the composition shown in Table 1 below was smelted according to an ordinary smelting method, the molten steel was cooled to make a slab (cross-sectional shape: 210 mm×150 mm), heated thereafter to 1,100° C., hot-rolled to make a hot rolled plate with a plate thickness: 45 mm, heated to 930° C., quenched (Q), tempered (T) by heating to 650° C., and a thick steel plate (QT steel plate) was manufactured.

TABLE 1

| Test | Chemical componential composition* (mass %) | | | | | | | | | | | | | | |
|---|---|---|---|---|---|---|---|---|---|---|---|---|---|---|---|
| No. | C | Si | Mn | P | S | Cu | Al | Ni | Cr | Mo | V | Nb | Ti | Ca | N |
| 1 | 0.13 | 0.25 | 1.31 | 0.010 | 0.002 | 0.20 | 0.035 | 0.44 | 0.15 | 0.10 | 0.036 | 0 | 0 | 0.0015 | 0.0046 |
| 2 | 0.13 | 0.26 | 1.30 | 0.010 | 0.002 | 0.20 | 0.031 | 0.46 | 0.15 | 0.27 | 0.035 | 0 | 0 | 0.0013 | 0.0045 |
| 3 | 0.16 | 0.24 | 1.30 | 0.009 | 0.002 | 0.18 | 0.030 | 0.35 | 0.18 | 0 | 0.032 | 0.004 | 0 | 0.0014 | 0.0048 |
| 4 | 0.16 | 0.26 | 1.02 | 0.010 | 0.002 | 0.17 | 0.029 | 0.28 | 0.24 | 0.09 | 0.033 | 0 | 0 | 0.0015 | 0.0047 |
| 5 | 0.12 | 0.26 | 1.48 | 0.008 | 0.001 | 0.28 | 0.030 | 0.42 | 0.21 | 0.07 | 0.020 | 0 | 0 | 0.0015 | 0.0050 |
| 6 | 0.13 | 0.25 | 1.30 | 0.005 | 0.001 | 0.20 | 0.031 | 0.42 | 0.15 | 0.15 | 0.035 | 0.007 | 0 | 0.0015 | 0.0051 |
| 7 | 0.13 | 0.25 | 1.29 | 0.010 | 0.002 | 0.20 | 0.031 | 0.46 | 0.15 | 0.10 | 0.035 | 0.003 | 0 | 0.0013 | 0.0047 |
| 8 | 0.14 | 0.24 | 1.03 | 0.010 | 0.002 | 0.34 | 0.030 | 0.51 | 0.24 | 0.03 | 0.034 | 0.018 | 0 | 0.0014 | 0.0052 |
| 9 | 0.13 | 0.26 | 1.48 | 0.010 | 0.002 | 0.07 | 0.031 | 0.15 | 0.12 | 0.28 | 0.026 | 0.004 | 0 | 0.0015 | 0.0049 |
| 10 | 0.13 | 0.28 | 1.33 | 0.010 | 0.002 | 0.23 | 0.031 | 0.44 | 0.17 | 0.12 | 0.039 | 0.003 | 0 | 0.0014 | 0.0050 |
| 11 | 0.12 | 0.06 | 1.49 | 0.009 | 0.002 | 0.48 | 0.031 | 0.54 | 0.05 | 0.11 | 0.036 | 0.007 | 0.012 | 0.0013 | 0.0048 |
| 12 | 0.16 | 0.45 | 1.31 | 0.010 | 0.002 | 0.12 | 0.029 | 0.21 | 0.06 | 0.20 | 0.035 | 0.005 | 0 | 0.0015 | 0.0050 |
| 13 | 0.13 | 0.26 | 1.29 | 0.008 | 0.002 | 0.16 | 0.024 | 0.35 | 0.15 | 0.14 | 0.028 | 0.006 | 0.023 | 0.0014 | 0.0064 |
| 14 | 0.12 | 0.24 | 1.38 | 0.010 | 0.002 | 0.23 | 0.030 | 0.42 | 0.30 | 0.05 | 0.034 | 0.015 | 0 | 0.0013 | 0.0048 |
| 15 | 0.15 | 0.26 | 1.38 | 0.010 | 0.002 | 0.18 | 0.030 | 0.38 | 0.14 | 0.08 | 0.036 | 0.013 | 0 | 0.0015 | 0.0050 |

*Balance: Iron and inevitable impurities other than P, S, N

Using each steel plate obtained as described above, the strength (TS) and the toughness ($vE_{-51}$) of the base metal as well as the toughness ($vE_{-34}$) and the area ratio of the grain boundary cementite in the CG-HAZ were evaluated according to a method described below. Also, in a measuring method described below, three test pieces each were used for all the steel plates, and the minimum value of them was obtained.

[Evaluation of Strength (TS) of Base Metal]

Test pieces of ASTM A370-05 (0.500 inch round specimen) were taken in the direction orthogonal to the rolling direction from the t (plate thickness)/4 portion of each steel plate, the tensile test was conducted according to the procedure of ASTM A370-05, and the tensile strength (TS) was measured. Then, one with 585 MPa or above of TS was evaluated to have passed.

[Evaluation of Toughness ($vE_{-51}$) of Base Metal]

Test pieces of ASTM A370-05 were taken in the direction orthogonal to the rolling direction from the t (plate thickness)/4 portion of each steel plate (base metal), the toughness of the base metal was evaluated. A Charpy impact test was conducted at −51° C. according to ASTM A370-05, and absorbed energy ($vE_{-51}$) was measured. Then, one whose minimum value of $vE_{-51}$ was 100 J or above was evaluated to be excellent in toughness.

[Evaluation of Toughness ($vE_{-34}$) in CG-HAZ]

In order to obtain the CG-HAZ structure, test pieces of 12.5 mm (the length in the plate thickness direction)×55 mm (the length in the width direction)×32 mm (the length in the rolling direction) were taken from the t (plate thickness)/4 portion of each steel plate (base metal), a heat cycle test according to the conditions described below was conducted, and the toughness in the CG-HAZ was evaluated. In the heat cycle test, the test piece was heated to 1,350° C. and maintained for 5 seconds, was cooled then for about 30 seconds over the temperature range of 800-500° C., thereafter tempering was performed for 15 minutes at 600° C. imitating the thermal effect of a succeeding pass, and a heat cycle equivalent to 40 kJ/cm of welding input heat was applied. A Charpy impact test was conducted at −34° C. according to ASTM A370-05, and absorbed energy ($vE_{-34}$) was measured. Then, one whose minimum value of $vE_{-34}$ was 48 J or above was evaluated to be excellent in toughness of the CG-HAZ.

[Evaluation of Area Ratio of Grain Boundary Cementite in CG-HAZ]

The center portion of each test piece on which the heat cycle test described above was conducted was subjected to etching according to Le Pera's method, four fields of view were observed for the field of view of 60×80 ($\mu m^2$) by an optical microscope of 1,000 magnifications, the image data was thereafter image-analyzed, and the area ratio of the cementite precipitated in the grain boundary was calculated.

These results are shown in Table 2 below along with the quenching temperature and tempering temperature.

TABLE 2

| | | | | Base metal | | | CG-HAZ | |
|---|---|---|---|---|---|---|---|---|
| Test No. | Plate thickness (mm) | Quenching temperature (° C.) | Tempering temperature (° C.) | TS (MPa) | $vE_{-51}$ (J) | $vE_{-34}$ (J) | Area ratio of grain boundary cementite (%) | RP value |
| 1 | 45 | 930 | 650 | 616 | 184 | 10 | 18.0 | $1.2 \times 10^{-8}$ |
| 2 | 45 | 930 | 650 | 686 | 139 | 26 | 16.8 | $3.2 \times 10^{-8}$ |
| 3 | 45 | 930 | 650 | 649 | 167 | 8 | 18.4 | 0 |
| 4 | 45 | 930 | 650 | 596 | 185 | 6 | 18.7 | $1.0 \times 10^{-8}$ |
| 5 | 45 | 930 | 650 | 664 | 143 | 7 | 19.5 | $4.8 \times 10^{-9}$ |
| 6 | 45 | 930 | 650 | 654 | 175 | 63 | 11.5 | $1.4 \times 10^{-7}$ |
| 7 | 45 | 930 | 650 | 638 | 176 | 55 | 12.0 | $4.6 \times 10^{-8}$ |
| 8 | 45 | 930 | 650 | 606 | 183 | 63 | 11.2 | $6.4 \times 10^{-8}$ |
| 9 | 45 | 930 | 650 | 694 | 127 | 59 | 11.6 | $1.5 \times 10^{-7}$ |
| 10 | 45 | 930 | 650 | 667 | 161 | 57 | 11.9 | $5.6 \times 10^{-8}$ |
| 11 | 45 | 930 | 650 | 689 | 161 | 64 | 11.3 | $1.0 \times 10^{-7}$ |
| 12 | 45 | 930 | 650 | 668 | 169 | 60 | 11.7 | $1.4 \times 10^{-7}$ |
| 13 | 45 | 930 | 650 | 628 | 171 | 62 | 11.4 | $1.1 \times 10^{-7}$ |

TABLE 2-continued

| Test No. | Plate thickness (mm) | Quenching temperature (° C.) | Tempering temperature (° C.) | Base metal TS (MPa) | Base metal $vE_{-51}$ (J) | Base metal $vE_{-34}$ (J) | CG-HAZ Area ratio of grain boundary cementite (%) | RP value |
|---|---|---|---|---|---|---|---|---|
| 14 | 45 | 930 | 650 | 662 | 158 | 54 | 11.5 | $9.0 \times 10^{-8}$ |
| 15 | 45 | 930 | 650 | 685 | 140 | 57 | 12.1 | $1.3 \times 10^{-7}$ |

From Tables 1, 2, following consideration is possible (the No. below represents the test No. in Tables 1, 2). Nos. 6-15 are the examples satisfying the requirement stipulated in the present invention whose chemical componential composition and the RP value are within the range stipulated in the present invention, and it is known that precipitation of the grain boundary cementite is suppressed in the CG-HAZ (less than 13% in terms of the area ratio) and the steel plate excellent in low-temperature toughness is obtained.

On the other hand, Nos. 1-5 are those not satisfying the RP value stipulated in the present invention in which the precipitation amount of the grain boundary cementite is much in the CG-HAZ (13% or above in terms of the area ratio), and are inferior in low-temperature toughness.

Figure 2:
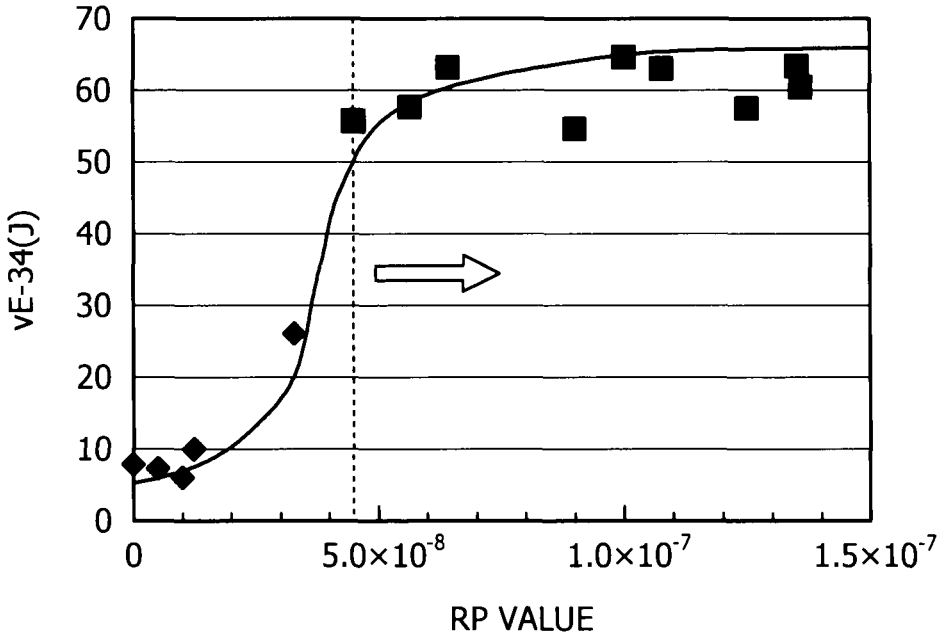
FIG. 2 is a graph showing the relation between the RP value and $vE_{-34}$.

Based on these results, the relation between the RP value and the area ratio (%) of the grain boundary cementite is shown in FIG. 1, and the relation between the RP value and $vE_{-34}$ is shown in FIG. 2 respectively. As is apparent from the result, it is known that formation of the grain boundary cementite can be reduced and excellent low-temperature toughness can be secured by controlling the RP value to $4.5\times10^{-8}$ or above.

What is claimed is:

1. A thick steel plate, comprising:

C: 0.12-0.16% (means mass %, hereinafter the same),
Si: 0.05-0.5%,
Mn: 1-1.5%,
Al: 0.01-0.05%,
Nb: 0.003-0.02%,
Mo: 0.03-0.3%,
V: 0.025-0.04%,
Cr: 0.05-0.3%,
Cu: 0.05-0.5%,
Ni: 0.15-0.55%,
Ca: 0.0005-0.006%,
iron and inevitable impurities, wherein;

RP value as defined by an equation (1) below satisfies a relation of $RP \geq 4.5\times10^{-8}$, $$RP=\{[Nb]/93+1/60\times[V]/51\}\times[Mo]/96 \quad (1)$$

where [Nb], [V] and [Mo] respectively represent the content (mass %) of Nb, V and Mo, wherein the thick plate has 585 MPa or above of tensile strength.

2. The thick steel plate according to claim 1, comprising Ti: 0.025% or below.

3. The thick steel plate according to claim 1, comprising Nb: 0.004-0.01%.

4. The thick steel plate according to claim 1, comprising V: 0.030-0.04%.

5. The thick steel plate according to claim 1, comprising Mo: 0.10-0.20%.

6. The thick steel plate according to claim 1, consisting of:

C: 0.12-0.16% (means mass %, hereinafter the same),
Si: 0.05-0.5%,
Mn: 1-1.5%,
Al: 0.01-0.05%,
Nb: 0.003-0.02%,
Mo: 0.03-0.3%,
V: 0.025-0.04%,
Cr: 0.05-0.3%,
Cu: 0.05-0.5%,
Ni: 0.15-0.55%,
Ca: 0.0005-0.006%,
iron and inevitable impurities, wherein;

RP value as defined by an equation (1) below satisfies a relation of $RP \geq 4.5\times10^{-8}$, $$RP=\{[Nb]/93+1/60\times[V]/51\}\times[Mo]/96 \quad (1)$$

where [Nb], [V] and [Mo] respectively represent the content (mass %) of Nb, V and Mo, wherein the thick plate has 585 MPa or above of tensile strength.

7. The thick steel plate according to claim 1, wherein a thickness of the thick steel plate is 3 mm or above.

8. The thick steel plate according to claim 1, wherein a thickness of the thick steel plate is in a range of from 3 mm to 45 mm.

* * * * *